United States Patent [19]

Ferree

[11] 3,995,250

[45] Nov. 30, 1976

[54] PORTABLE TRAFFIC SIGNAL LIGHT

[76] Inventor: Robert W. Ferree, 435 Parkview Drive, Wynnewood, Pa. 19096

[22] Filed: Nov. 5, 1975

[21] Appl. No.: 628,882

[52] U.S. Cl. ..... 340/41 A; 340/119; 240/73 BA; 240/22; 240/41.3; 248/207; 248/316 R

[51] Int. Cl.[2] ..... G08G 1/00

[58] Field of Search ..... 340/41 A, 110, 119; 240/22, 73 BA, 41.3

[56] References Cited

UNITED STATES PATENTS

| | | | |
|---|---|---|---|
| 1,363,566 | 12/1920 | Churchill | 240/22 |
| 2,022,209 | 11/1935 | Lawyer | 240/73 BJ |
| 2,941,185 | 6/1960 | Mullikin | 340/41 A |

*Primary Examiner*—Thomas B. Habecker
*Attorney, Agent, or Firm*—Dorfman, Herrell and Skillman

[57] ABSTRACT

A portable apparatus providing for a temporary installation of a traffic control signal meeting the visual display requirements as specified by government authorities for standard traffic control lights. The apparatus includes a standard which is adapted to support the traffic signal heads at proper positions, both alongside the roadway and in an elevated position above the roadway, a control box for controlling the operation of the signal either in accordance with a pre-set program or in accordance with signals generated automatically or manually in response to traffic flow, a base element having means to anchor the unit firmly in place and to hold the vertical mast, the vertical mast with means for mounting the signal head at a proper elevation alongside the roadway, and a mast arm or boom pivotally attached adjacent to the upper end of the mast so that the boom can be readily positioned in a substantially horizontal alignment above the roadway and means to securely anchor the boom in the horizontal position, the boom also having means for mounting a signal head. The apparatus is designed to be carried and erected with a minimum effort. The base may be a separate piece, or a fitting firmly attached to a vehicle, or a semi-permanent installation attached to the ground. The vertical mast is releasably engageable with the base, said mast and base having cooperable elements facilitating erection and locking of the mast in a vertical position. An improved traffic control signal section is in the form of a lens assembly which combines the functions of the traditional housing and reflector in one piece to reduce the weight and cost of the assembly, the construction permitting ready maintenance of the system.

21 Claims, 5 Drawing Figures

PORTABLE TRAFFIC SIGNAL LIGHT

The present invention relates to traffic control systems which embody signal lights, and it is particularly applicable to control systems embodying portable signals for temporary installation on highways.

Over the years, it has been a problem to maintain traffic flow at construction sites in sections of highways which must be repaired. The problem is critical where the repairs require the closure of a traffic lane or lanes for a period to permit rebuilding of the roadway or to permit access of the construction vehicles to the construction site. Where two unimpeded traffic lanes are not available, flagmen are often used to control the traffic flow so that a signal lane may be used alternatively for traffic flow in opposite directions, or where traffic must be stopped in both directions for short periods to permit crossing construction traffic or operations.

Another traditional practice has been the use of police officers standing in the road to control traffic at special events or unusual occasions where a full-time signal cannot be justified, but where more positive control is required for the duration of the event.

Prior systems for controlling traffic through the use of traffic signal lights have involved either equipment which doe not meet present highway department standards, or considerable expense in the erection and maintenance of a control system primarily designed for permanent installations.

With the foregoing in mind, the present invention provides a traffic control system which may be erected and removed with a minimum expenditure of time and effort and yet meets the highway department requirements regarding the position and arrangement of signal lights (see *Manual on Uniform Traffic Control Devices for Streets and Highways*, as approved by Federal Highway Administration on Nov. 13, 1970, and adopted by various states).

More particularly, the present invention provides equipment which may be carried to the required site on construction vehicles or on police cars without difficulty and which may be erected at the commencement of the situation and removed at the conclusion of the operation without substantial expediture of time or effort, and will provide clear and unambiguous indication to the motorist.

The present invention provides, as a component of the traffic control system, a standard which is readily erected to provide a support for traffic control signal lights which is sturdy and durable and is fully effective in positioning the signal lights at the proper position relative to the roadway without impeding the traffic flow on the roadway, and yet allows for storage in a confined area when not in use.

The present invention also provides a novel lens assembly for use in a traffic control signal section and signal head assembly that combines the functions of the usual housing and the usual reflector in a single piece to provide a lightweight assembly which is sufficiently strong and durable to withstand the rigors of outdoor use and yet which provides easy access for replacement or repair of the lighting element thereof.

All of the objects of the invention are more fully set forth hereinafter with reference to the accompanying drawings, whrein:

Figure 1:
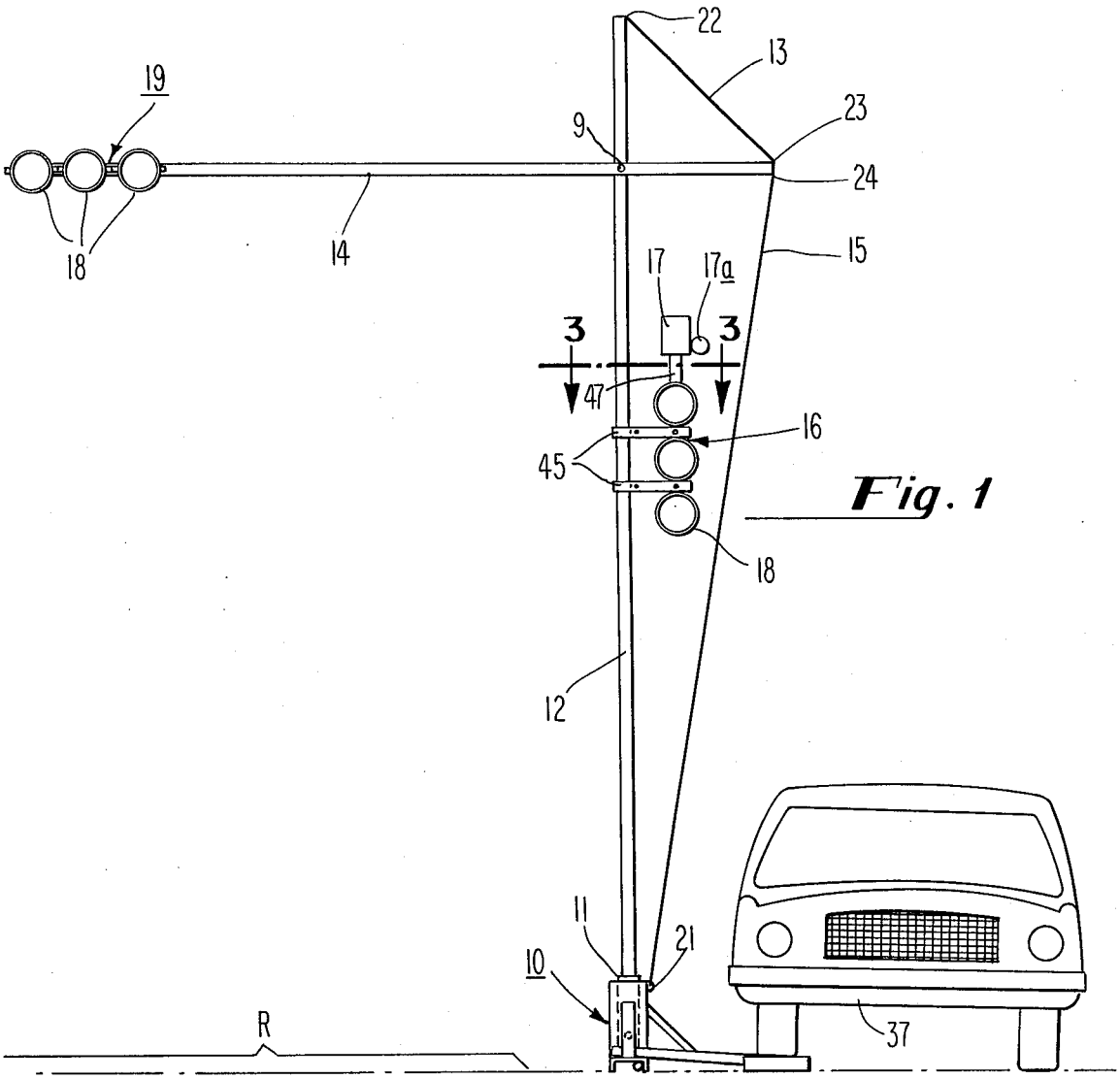
FIG. 1 is a view of a traffic control standard made in accordance with the present invention.

Referring now to the drawing, the apparatus illustrated therein comprises a base 10 having a socket 11 pivoted therein. A vertical staff or mast 12 is adapted to engage in the socket and has near the top thereof a boom or mast arm 14 pivoted thereto at 9 and adapted to extend outwardly therefrom, as shown in FIG. 1. Strut means is provided to anchor the boom in position, in the present instance comprising flexible cable runs 13 and 15. At proper elevation on the vertical mast 12, a traffic control signal head 16 is mounted, which, in the present instance, includes a control box 17 and three individual operable signal sections 18. As shown, the head 16 also includes an indicator display **17*a* which may be used to indicate the operating condition of the signal head to a workman who cannot observe the signal sections. A similar signal head is mounted on the end of the mast arm at 19, the overhead signal head 19 comprising in the present instance of three signal sections 18 without either an indicator or a separate control box. The signal head 19, as shown in FIG. 1, is arranged in a horizontal array, although different arrangements of the signal sections might be used in other configurations. Suitable connections (not shown) are provided between the signal sections in the signal head 19 and the signal sections 18 and the control box 17 in the signal head 16** so that the signal lights operate concurrently as required.

In the embodiment of the invention illustrated in FIG. 1, the signal heads 16 and 19 comprise three signal section assemblies which are red, amber, and green for use identical to the standard traffic control signal. In lieu of this form of signal head, flashing yellow or flashing red signal heads may be installed, or a flashing arrow signal head may be used as illustrated in FIG. 5.

Figure 5:
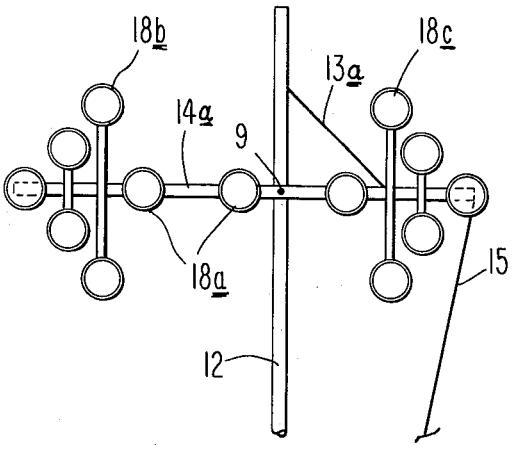
FIG. 5 is a fragmentary view of the traffic control standard made in accordance with the present invention with an alternate form of mast arm and signal light assembly.

In the embodiment shown in FIG. 5, the mast arm **14*a* is shorter than the arm 14, but is pivoted at 9*a* to the mast 12 like the pivot 9. The strut means for supporting the arm 14*a* includes cable runs 13*a* and 15, in the present case the run 13*a* is anchored close to the pivot 9*a*, as compared to the relative positions of the run 13 and the pivot 9. The runs 15 of these embodiments are identical and cooperate with the base 10 to support the mast 12 in the vertical position with the mast arm elevated. The signal head of the embodiment in FIG. 5 comprises an array of signal lamps arranged in an arrow display. In this case the array includes a plurality of 5 lamps disposed in a horizontal row 18*a*, and clusters of 4 lamps 18*b* and 18*c*** at each end forming left and right arrow heads. The lamps may be connected to a power source for energization in the conventional sequences for arrow boards.

With reference to the drawings, the support standard for the signal heads 16 and 19 is designed for easy erection and removal. To this end, the staff 12 is readily mounted on and dismounted from the base 10 and the mast arm 14 is pivoted to the upright staff 12 for adjustment into lengthwise alignment adjacent the staff 12. The staff 12 and the mast arm 14 are preferably composed of lightweight tubular stock which is possessed of sufficient strength and durability to withstand the elements when used in the field. Pivotal displacement of the mast arm 14 on the pivot 9 is afforded by reason of the flexible strut means. The upper cable run 13 is anchored at one end near the top of the vertical staff 12, as indicated at 22, and is anchored as indicated at 23 near the inner end of the mast arm 14. The flexible cable run 15 is anchored as indicated at 24 to the inner end of the mast arm 14 and is hooked to a support anchor 21 on base 10 at its lower end. The length of the cable runs between the connections 22 and 23 and between 24 and 21 are such that when the strut is anchored at 21, the mast arm 14 is disposed substantially horizontally outwardly over the roadway R above the path of the vehicles which are to be controlled. It is noted that the cable run 15 also functions to resist any upward displacement of the staff 12 out of the socket 11. When it is desired to remove the standard, the run 15 is disengaged from the anchor at 21 andthe flexible nature of the cable run 13 permits the mast arm 14 to pivot counter-clockwise on the pivot 9, in the present instance, into alignment alongside the vertical staff 12. The staff 12 may be formed in two sections to facilitate its stowage by a suitable joint (not shown) disposed below the signal head 16.

At its lower end, the staff 12 is adapted to telescopically engage within the socket of the base 10. In lieu of the illustrated base, the base may be a simple pipe driven into the ground, or a tube bolted onto a vehicle, or may take other possible forms. The particular base illustrated and described herein was selected as being the most practical for varied applications.

Figure 2:
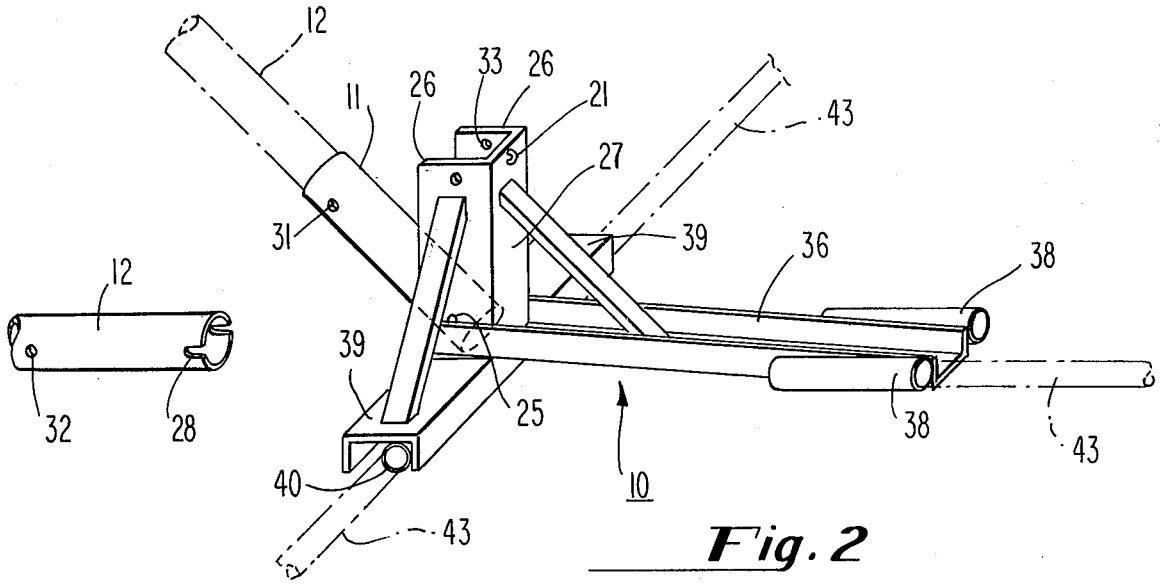
FIG. 2 is a perspective view of a supporting base element with the end portion of the vertical staff removed and separated therefrom, and showing in broken lines portions of the extended weight elements adapted to engage the base.

The socket 11 is pivoted to the base 10 adjacent to its lower end, as indicated at 25, by a stud passing between the flanges 26, 26 of the upright element 27 of the base 10. The lower end of the staff 12 is notched, as indicated at 28 in FIG. 2, to engage the stud and firmly position the staff 12 in proper alignment with the socket 11. Adjacent the upper end of the socket 11, apertures are provided at 31, and similar apertures are provided in the staff 12, as indicated at 32. The flanges 26 are likewise apertured, as indicated at 33, so that when the socket 11 is pivoted into the upright position shown in FIG. 1, the apertures 31, 32 and 33 register with one another to permit the passage of a fastener therethrough. When fastened in this manner, the staff 12 is positioned upright and the notches 28 and the apertures 32 insure proper angular orientation of the signal heads 16 and 19 on the vertical axis through the socket 11.

The base 10 is adapted to be temporarily anchored by the use of suitable weight. The base is designed particularly to be anchored by the use of a vehicle 37 which may be parked with a wheel resting on the support means 38 of the extension arm 36, as shown in FIG. 1. The weight of the vehicle on the base provides a sufficient anchoring force to maintain the staff upright with the mast arm 14 extended over the roadway R, as shown, in spite of high wind loads. With the substantial weight of the vehicle resting on the base 10, the support means 38 may be positioned relatively close to the upright 27, enabling the vehicle 37 to be parked alongside the roadway in the shoulder area. The support means 38 includes cylindrical pipe portions mounted alongside the side flanges of the inverted channel member 36 so that the wheel of the vehicle will not tend to roll off the support while in use. Support for the staff 12 in the direction transverse to the main channel 36 is provided by cross arms 39 which extend parallel to the roadway in the present instance as shown in FIG. 1. Thus, the extension arm 36 and the cross arms 39 form a T-structure which provides a three-point support for the standard.

In other applications or sites, it may not be possible or desirable to employ a vehicle 37 as the weighting member for the base 10. To accommodate the structure in this eventuality, tubular inserts 40 are mounted interiorly of the cross arms 39 and the pipes of the support 38 are designed to provide a socket for extender weighting members shown in broken lines 43 of FIG. 2. The sockets extend parallel to the ground in the members of the T-structure so that the extenders, in effect, are extensions of members 36 and 39. The extenders provide an enlarged three-point support which may facilitate anchoring of the base 10 by the use of sandbags or other weighting elements. The use of the extenders 43 with suitable weighting elements on the ends, which may have considerably less weight than the vehicle 37, enables the upright staff to be held in the vertical position in spite of possible wind loads.

It should be noted that the construction of the base facilitates the erection of the vertical staff 12. In operation, the staff 12 and the adjacent mast arm or boom 14 may be held in the horizontal position and the tubular socket 11 pivoted downwardly so that the staff 12 may be displaced axially into the telescopic engagement with the socket, the notches 28 engaging with the pivot stud at 25. When so engaged, the apertures 32 register with the apertures 31 in the socket. The staff 12 may then be erected to the vertical position by a single person starting at the far end of the staff 12 and walking toward the base 10 raising the staff 12 to the vertical position. When the staff is in the vertical position, the apertures 31 and 32 register with apertures 33, the fastener may be positioned in place. With the staff 12 vertical, the boom 14 may then be elevated by tensioning the cable run 15 and anchoring its free end with the strut anchor at 21.

Figure 3:
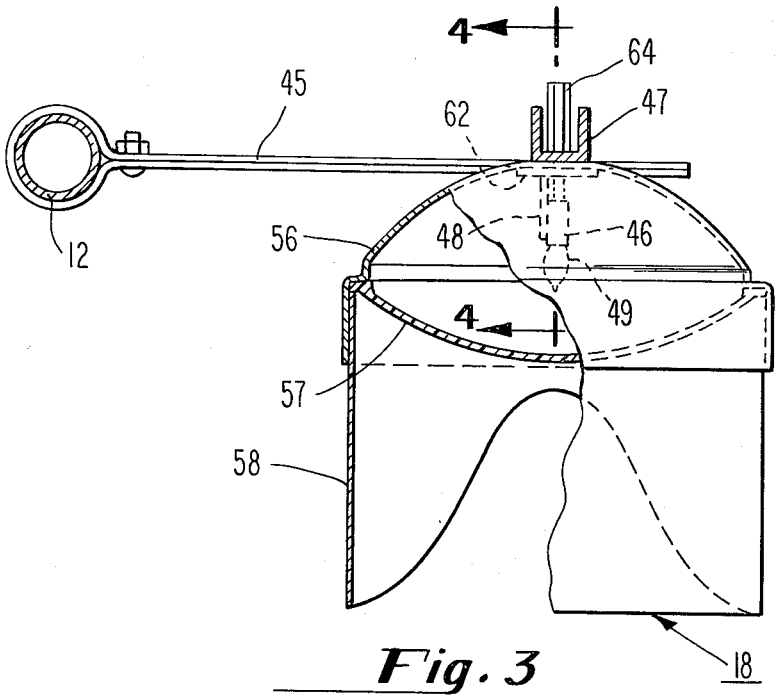
FIG. 3 is an enlarged sectional view taken along the line 3—3 of FIG. 1.
Figure 4:
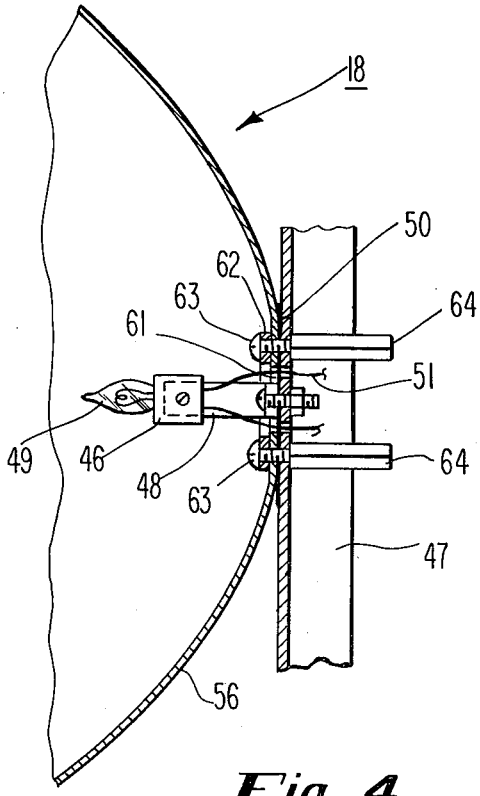
FIG. 4 is an enlarged sectional view taken along the line 4—4 of FIG. 3.

The present invention provides a signal head assembly which is of lightweight construction so as to keep the entire device at a minimum weight for ease of handling. As shown in FIGS. 1, 3 and 4, the signal head 16 comprises a light support bar 47 which is clamped parallel to the staff 12 by clamps 45, and the signal section assemblies 18 which are fastened to the channel 47. The head 19 includes a similar support bar which may be clamped to the mast arm 14 in a similar manner. For convenience, in the present instance, the control box 17 and the indicator light **17*a* are mounted on the support bar 47 of the signal head 16.**

The light support bar 47 comprises a channel member having plural, in the present instance three, bulb socket supports 48 extending outwardly from the face thereof. The bulb socket support 48 is mounted on one surface of the channel 47 against a rubbber gasket or sealing element 50 which is glued to the channel 47. A bulb socket 46 is mounted on each bulb socket support 48, and a high intensity miniature bulb 49 is mounted in each socket. Suitable electrical connectors 51 are attached to the socket 46 and pass through the gasket 50 and the channel 47 for electrical connection on the opposite side of the channel (see FIG. 4).

The bulb socket supports 48 are preferably permanently mounted on the channel 47 in properly spaced relation therealong to comply with the standard signal light specifications of the highway department, the connections from 51 being connected into the control box 17 in conventional manner. When the controls for the signal light are remote from the mounting bar 47, such as with the signal head 19, or when the control box 17 is placed near signal head 16, the connections 51 may constitute the terminal end of a multi-wire cable leading to the control box 17 or other control device. The miniature bulb 49 provides a sufficient light output to comply with the requirements when mounted with a suitable reflector and lens.

In accordance with the present invention, each signal section comprises a lightweight reflector and lens assembly 18 used in conjunction with the light bar 47. To this end, as shown in FIGS. 3, 4 and 5, the reflector and lens assembly is composed of a lightweight plastic parabolic shell having a reflective finish on the interior surface 52 thereof. To eliminate the need for a separate housing around a separate reflector, the reflective surface 52 is made integral with the plastic shell 56. In order to match the optics with the standard traffic signal lens, the plastic reflector shell is molded with slight surface indentations providing a degree of diffusion of the light reflected therefrom. The shell 56 is substantially parabolic in configuration with its axis and its focal point in registry with the bulb 49. The parabolic configuration terminates at the free edge of the shell in a generally circular shoulder and a coaxial straight cylindrical portion. The cylindrical portion and the shoulder of the shell 56 mount a standard lens 57 which is green, amber or red, as required. The lens 57 is permanently mounted in shell 56 to provide a weathertight assembly which protects the bulb 49 and its mount from the elements. A visor element 58 is also mounted in the cylindrical portion of the shell 56 to shield the lens 57 from the effect of the sun, as suggested by the highway authorities. The permanent assembly of the shell 56, lens 57, and visor 58 insures against penetration of the elements into the interior of the signal section from the front.

To obtain access to the interior of the housing for bulb replacement purposes, the housing is releasably mounted on the support bar 47. To this end, the shell 56 has a circular opening 61 at its center and is provided with a mounting ring or washer 62. The opening 61 is large enough to permit the passage of the bulb, bulb socket, and the socket support. The mounting washer 62 has threaded mounting studs 63 extending outwardly therefrom passing through the shell 56. The studs 63 are designed to have their threaded shanks pass through the gasket 50 and through openings surrounding the bulb socket support 48 in the web of bar 47. Elongated retaining nuts 64 engage the threaded shanks of the bolts 63 and may be tightened against the rear face of the bar 47 to anchor the assembly in place and seal the shell 56 against the gasket 50. Alternately, the mounting washer 62 may be made with threaded holes and the assembly fastened to the bar 47 with shoulder screws (not shown).

Thus, to disassemble the lens assembly 18 for bulb replacement, the nuts 64 are loosened and removed and the shell is displaced over the bulb 49 and the bulb support 48 to expose these elements. Removal of the shell 56 permits replacement of the bulb 49 and then the shell may be replaced on the lamp bar 47 with nuts 64.

In the illustrated embodiment of the support standard, one head 16 is mounted on the upright staff 12 and one head 19 is mounted on the mast arm 14, both signal heads facing the same direction. The lightweight character of the signal heads permits additional signal heads to be mounted on the standard facing in the opposite direction, for instance where a single standard is erected for controlling traffic flow in both directions, such as a pedestrian-crossing situation. The visual conformity of the elements of the system to the standard traffic control components enables easy recognition by the driver.

It should be noted that the illustrated embodiment of the invention locates the roadside signals 16 above the minimum height of eight feet elevation above the roadway, and locates the overhead signal more than the minimum height of fifteen feet above the roadway at a distance greater than eight feet measured horizontally from the signal on the mast to meet the specifications of the *Manual for Uniform Traffic Control Devices*.

The extreme simplicity by which the standards of the present invention may be erected and removed enables, to a large extent by the lightweight signal sections and heads, a wide flexibility in traffic control in situations where, heretofore, it was not feasible and practical to provide traffic control signals. For example, standards may be set up to replace flagmen in many construction situations, and may be set up for special events such as sporting events, carnivals, supermarket openings and the like, which now require the use of policemen standing in the roadway to control traffic. The present invention aids in more effective traffic control with less danger to the lives of policemen, workers and the drivers.

While particular embodiments of the present invention have been illustrated and certain possible modifications have been described, it is not intended to limit the invention to such disclosures, but changes and modifications may be made therein and thereto within the scope of the following claims.

I claim:

1. A portable standard for mounting traffic-control lights along a roadway for vehicles comprising a portable vertical staff, a base mounting said staff comprising a tubular socket element adapted to receive the lower end portion of said staff and support the same vertically positioned alongside the roadway, a boom pivoted to said staff adjacent its upper end and adapted to extend outwardly from said staff over said roadway, means to mount a traffic-control signal light assembly on said boom remote from said staff whereby when said base is positioned alongside the roadway, said boom positions the signal light assembly over the roadway at a predetermined elevation, and strut means to anchor said boom in its outwardly-extending position.

2. A portable standard accordng to claim 1, including releasable anchor means to releasably anchor said strut means in its operative position, said strut means, upon release of said anchor means, permitting pivotal displacement of said boom into alignment along said vertical staff.

3. A portable standard according to claim 2 whrein said strut comprises a first flexible cable run extending between said boom and said base and including said releasable anchor means, and a second flexible cable run fixed at one end to the said vertical staff and fixed at the other end to said boom, the length of said second run preventing further pivotal movement of said boom from said aligned position beyond said outwardly extended position, the length of said first run between the base and said boom, when tensioned, being operative to position said boom horizontally relative to said vertical staff.

4. A standard according to claim 1 wherein said signal light assembly comprises a plurality of signal lights operable in a sequence to control traffic flow.

5. A standard according to claim 4 including a second traffic-control light assembly mounted alongside said roadway on said vertical staff between said boom and said base, said second assembly comprising a plurality of signal lights operable in the same sequence as said over-the-roadway signal light assembly

6. A standard according to claim 5, including a control box mounted on said vertical staff and connected to both of said signal light assemblies to control the sequence of operation of said signal lights.

7. A standard according to claim 1 werein said signal lights comprise an array of lamps arranged in an arrow display and including a horizontal row of lamps, a cluster of lamps forming a left arrow head at one end of said row, and a cluster of lamps forming a right arrow head at the other end of said row.

8. A standard according to claim 1 wherein said signal light assembly comprises at least one lens assembly having a lightweight parabolic shell having a reflective interior surface terminating in a generally circular shoulder, and a lens mounted on said shoulder, said shell constituting the only support for said lens.

9. A portable standard according to claim 1 including a signal head carried by said head-mounting means, said head comprising a light-support bar having a plurality of bulb supports extending outwardly from one face thereof at spaced points along said bar, electrical connections for selectively energizing the bulbs in said supports, and a lens assembly for each bulb support, said lens assembly including a reflector having a central aperture for receiving said bulb support therein, and means mounting each said lens assembly on said light-support bar so that the bulb support positions the bulb in operative relation within said reflector.

10. A portable traffic-control light standard according to claim 9 wherein said lens assembly reflector comprises a plastic shell of generally parabolic configuration with a reflective inner surface, said shell terminating at its outer end in a cylindrical extension mounting a lens therein, said lens being permanently secured to said shell, said mounting means comprising a ring surrounding the central aperture of said reflector shell and fasteners extending outwardly from said ring to releasably fasten said assembly to the said one face of the light-support bar.

11. A standard according to claim 10, including a shield-visor mounted in said cylindrical extension and surrounding said lens, said visor extending outwardly above said lens to shield the lens from direct sunlight.

12. A portable mounting standard for traffic-control lights comprising a vertical staff having means mounting signal lights thereon, a base mounting said staff in vertical position comprising a structure adapted to firmly but temporarily anchor said staff including an upright channel member having parallel side flanges extending upwardly, and a staff-receiving socket pivoted to said structure, said socket comprising a tubular element having a pivot stud passing therethrough to pivotally support the tubular socket between said flanges, said flanges and said socket having apertures equally spaced from said tubular pivot and operable to register with each other when said tubular socket is positioned upright between said side flanges, said vertical staff having at its lower end portion means to engage said pivot stud upon telescopic engagement of said staff in said socket and having an aperture spaced from said stud-engaging means a distance equal to the spacing of said apertures from said pivotal support whereby upon telescopic engagement of said staff in said socket and engagement of said stud-engaging means with said pivot stud, said staff apertures register with said socket apertures.

13. A portable standard according to claim 12 wherein said upright channel member is vertical, said pivot stud passing through the flanges of said member below said flange apertures.

14. A portable standard according to claim 12 wherein said structure comprises an anchoring support adapted to bear upon the ground and to accept the wheel of a motor vehicle thereon, said vehicle serving to retain said structure in proper position.

15. A portable standard according to claim 12 wherein said structure has cross members and a main member adapted to bear upon the ground and having socket means extending parallel to the ground adapted to receive extenders which provide an extended base area for receiving weighting elements which firmly anchor said structure.

16. A portable standard according to claim 12 wherein said signal-mounting means includes a boom pivoted to said staff adjacent its upper end and adapted to extend outwardly from said staff to mount a traffic light signal head at its remote end, whereby when said base is positioned alongside a traffic roadway, said boom positions the signal head over the roadway at an elevated height, and strut means to anchor said boom in its outwardly-extending position.

17. A portable standard according to claim 16, including releasable anchor means on said strut and said base to releasably anchor said strut in its operative position, said strut upon release of said anchor means permitting pivotal displacement of said boom into alignment alongside said vertical staff.

18. A portable standard according to claim 17 wherein said strut comprises a flexible cable run fixed at one end to said vertical staff and fixed at the other end to said boom, and a second cable run fixed at one end to said boom and releasably connected at the other end to the base, the length of said cable runs, when tensioned, being operative to position said boom horizontally relative to said vertical staff.

19. A signal head for traffic-control lights comprising a light-support bar and a plurality of signal lights mounted on said bar, said support bar having on one surface thereof a plurality of bulb-supports spaced apart a distance corresponding to the spacing of the signal lights, a bulb mounted in each support, electrical connections on the opposite surface of said bar for selectively energizing the bulbs in said bulb supports, and a lens assembly for each bulb including a reflector shell mounted on said one surface in position to reflect light from said bulb outwardly through the lens of said assembly, said shell having a central opening in circumscribing relation to bulb to afford displacement of said lens assembly outwardly from said bar to expose said bulb for replacement in said support.

20. A signal head according to claim 19 wherein said reflector shell comprises a lightweight plastic shell having a reflective interior surface characterized by a multitude of surface indentations, said shell having a substantially parabolic configuration which terminates at its outer side in a cylindrical extension, said lens being parmanently mounted in said extension with a weather-tight seal therebetween, whereby said shells constitute the only housings for the bulbs of said signal head.

21. A signal head according to claim 19 including mounting means on said lens assembly comprising a mounting ring in the base of said reflector and releasable fasteners securing said ring to said light-support bar.

* * * * *